United States Patent [19]

Matsumoto et al.

[11] Patent Number: 4,596,514

[45] Date of Patent: Jun. 24, 1986

[54] PRESSURE RESPONSIVE PUMP DRIVE MOTOR CONTROL APPARATUS HAVING SPOT SWITCH AND ALARM LAMP

[75] Inventors: Akio Matsumoto, Kanzaki; Mitsuyoshi Yokota, Ibo, both of Japan

[73] Assignee: Mitsubishi Denki Kabushiki Kaisha, Chiyodaku, Japan

[21] Appl. No.: 541,729

[22] Filed: Oct. 13, 1983

[30] Foreign Application Priority Data

Oct. 21, 1982 [JP] Japan ..... 57-160444[U]

[51] Int. Cl.[4] ..... F04B 49/06; F04B 21/00; G08B 21/00

[52] U.S. Cl. ..... 417/44; 417/63; 340/626; 307/118; 318/481

[58] Field of Search ..... 417/38, 44, 63; 340/611, 614, 626; 307/118; 318/481

[56] References Cited

U.S. PATENT DOCUMENTS

| | | | |
|---|---|---|---|
| 1,952,265 | 3/1934 | Leland | 417/44 X |
| 2,042,510 | 6/1936 | Cornelius et al. | 417/44 |
| 2,246,932 | 6/1941 | Collins | 417/62 |
| 2,891,625 | 6/1959 | Hube | 417/44 X |
| 3,050,003 | 8/1962 | Edwards | 417/63 X |
| 3,469,528 | 9/1969 | East | 417/44 X |
| 3,738,776 | 6/1973 | Debare | 417/44 X |
| 4,049,935 | 9/1977 | Gruber | 340/626 X |
| 4,277,226 | 7/1981 | Archibald | 417/63 X |
| 4,309,149 | 1/1982 | McCombs, Jr. | 417/63 |

FOREIGN PATENT DOCUMENTS

| | | | |
|---|---|---|---|
| 570111 | 2/1959 | Canada | 340/611 |

*Primary Examiner*—William L. Freeh
*Assistant Examiner*—Paul F. Neils
*Attorney, Agent, or Firm*—Wenderoth, Lind & Ponack

[57] ABSTRACT

A pressure control apparatus, which can be used for a braking force magnification apparatus for a vehicle or a door closing and opening apparatus includes a sensor for sensing a pressure within a vacuum booster. The sensor is of a transfer-contact-type including a medial movable contact and two stationary contacts. The movable contact makes contact with one of the stationary contacts connected to an alarm lamp but breaks contact with the other connected through a control circuit to a DC motor connected to a vacuum pump or a compressor when the absolute gauge pressure produced by the vacuum pump or compressor is below a first predetermined threshold value. The movable contact breaks contact with the one stationary contact to energize the DC motor when the absolute gauge pressure is below a second predetermined threshold value but is above the first one. When the absolute gauge pressure is above the second predetermined threshold value, the movable contact makes contact with the other contact to deenergize the DC motor.

9 Claims, 3 Drawing Figures

PRESSURE RESPONSIVE PUMP DRIVE MOTOR CONTROL APPARATUS HAVING SPOT SWITCH AND ALARM LAMP

BACKGROUND OF THE INVENTION

This invention relates to a pressure control apparatus, and in particular to an improved arrangement for a control apparatus of pressure equipment, such as braking apparatuses and door opening and closing apparatuses, driven by a motor in a vehicle.

In conventional braking apparatuses for vehicles, for example, only a foot braking force was available and so the braking effect was not satisfactory. However, in recent braking apparatuses a greater braking effect has been required due to road conditions and other factors, and there have been an increasing number of vehicles that utilize a braking force magnification apparatus which produces a greater braking effect than can be achieved by the foot alone. A braking force magnification apparatus with pressure generating means included therein can generate a pressure different from atmospheric pressure so that the difference between the generated pressure and atmospheric pressure may be available for braking operations. Accordingly, a braking force magnification apparatus requires a pressure control apparatus which can sustain the generated pressure at a predetermined value.

One example of such a pressure control apparatus used in the past is shown in FIG. 1 by a circuit diagram. In the figure, the pressure control apparatus is generally shown by a reference numeral 10 in which a vacuum pump or compressor 12 and a DC motor 14 connected to the pump 12 form a pressure generating means. The vacuum pump or compressor 12 will be considered to be a pump for the remainder of this explanation. The DC motor 14 is connected to the positive terminal of a DC power source 16 through a key switch 18, and the negative terminal of the source 16 is grounded. The motor 14 is also connected to a control circuit 20 surrounded by dotted lines. The control circuit 20 is connected to ground via sensor 22, and includes resistors R1 and R2 connected in series between one terminal of the key switch 18 and ground. One junction of the resistors R1 and R2 is connected to one of the contacts of the sensor 22, the other contact being grounded, and also to the base of a driver transistor Q1 whose emitter is grounded and whose collector is connected through a resistor R3 to the key switch 18 and to the base of a power transistor Q2, driven by the transistor Q1, whose emitter is grounded and whose collector is connected to the DC motor 14 as well as to the anode of a diode D which forms a parallel combination with the DC motor 14 connected to the key switch 18. Another sensor 24 is serially connected to an alarm lamp 26 between the series combination of the power source 16 and the key switch 18, as shown in the figure.

The vacuum pump 12 produces a negative gauge pressure in a vacuum booster or a reserve tank (both not shown), the negative pressure serving as a mechanical power source for braking operations. The sensors 24 and 22 are provided within the vacuum booster or the reserve tank such that they sense first (lower) and second (higher) predetermined threshold values of the negative gauge pressure respectively, at which time they are actuated.

In FIG. 1, the pressure generating means includes the DC motor 14 and the vacuum pump 12 while it may include the DC motor 14 as well as a compressor which produces a positive gauge pressure also serving as a mechanical power source for braking operations. In this case, the sensors 22 and 24 respond to first (lower) and second (higher) threshold values of the positive gauge pressure. For the sake of convenience, the following description will be made only with reference to a vacuum pump.

In operation, a conventional apparatus thus constructed closes the contacts of the sensors 22 and 24 when the absolute gauge pressure within the vacuum booster or reserve tank is approximately equal to atmospheric pressure before the key switch 18 is closed to make negative gauge pressure. In this state, when the key switch 18 is closed, the alarm lamp 26 is lighted through the closed contacts of the sensor 24 while the driver transistor Q1 is not conductive because its base is grounded through the closed contacts of the sensor 22, and so the power transistor Q2 is made conductive by the base current supplied through the resistor R3 from the power source 16. Therefore, the DC motor 14 is energized to decrease the absolute pressure, i.e. to direct negative the pressure within the vacuum booster through the vacuum pump 12, and then to increase the negative gauge pressure.

FIG. 2 will now also be referred to regarding the relationship between the operations of the sensors 22 and 24, and the degree of vacuum. As schematically shown in the figure, when the vacuum booster is negatively pressurized to the first predetermined threshold value A along the direction of the arrow, the sensor 24 is firstly actuated or made open and maintains this state as far as the gauge pressure goes more negative. In this state, the alarm lamp 26 is extinguished.

When the negative gauge pressure further rises to the second predetermined threshold value B, the sensor 22 is now actuated or made open and maintains this stage as far as the gauge pressure goes more negative. Therefore, the driver transistor Q1 is made conductive by its base current flowing through the closed key switch 18 and the resistor R1 from the power source 16 to ground, thereby making the power transistor Q2 non-conductive. Consequently, the DC motor 14 is deenergized to stop the pressurizing operation in the negative direction.

After the operation of the DC motor 14 is stopped, the negative gauge pressure within the vacuum pump now begins to fall gradually towards the second predetermined threshold value B, at which the contacts of the sensor 22 are closed and therefore the transistor Q1 is made non-conductive and the transistor Q2 is made conductive to energize the DC motor 14 as described above. The repetition of these operations will cause the vacuum booster or reserve tank to be maintained at the second predetermined negative gauge pressure B.

If the DC motor 14 or the vacuum pump 12 malfunctions for some reason, then the negative gauge pressure continues to fall towards the first predetermined threshold value A, at which the contacts of the sensor 24 are closed as shown in FIG. 2 to light the alarm lamp 26, signalling a warning.

Thus it is disadvantageous that the pressure control apparatus in the prior art employs two sensors, since the increased number of the components raises costs.

Accordingly, it is an object of the invention to provide a pressure control apparatus which has a simple arrangement and low cost.

SUMMARY OF THE INVENTION

In light of this object, the present invention comprises a pressure generating means, a pressure sensing means, and a control circuit. The pressure generating means generates a pressure different from atmospheric pressure when energized. The pressure sensing means is of a transfer-contact-type, providing alarm and pressurizing signals when the absolute value of the gauge pressure generated by said pressure generating means is below a first predetermined threshold value, providing a pressurizing signal when the absolute gauge pressure is below a second predetermined threshold value but is above the first value, and providing a stop signal when the absolute gauge pressure is above the second predetermined threshold value. The control circuit energizes or deenergizes the pressure generating means when the pressurizing or stop signal from the pressure sensing means is provided, respectively.

The pressure generating means preferably comprises a DC motor connected to the control circuit and a vacuum pump or a compressor connected to the DC motor. The pressure sensing means preferably has a first stationary contact connected to an alarm lamp, a movable contact connected to ground, and a second stationary contact connected to the control circuit. The first stationary and movable contacts are closed to provide the alarm and pressurizing signal, all of the contacts are made open with respect to one another to provide the pressurizing signal, and the movable and second stationary contacts are closed to provide the stop signal.

BRIEF DESCRIPTION OF THE DRAWINGS

Further objects and advantages of the present invention will be apparent from the following description, reference being had to the accompanying drawings wherein preferred embodiments of the present invention are clearly shown.

Throughout the figures, like reference numerals designate like or corresponding parts.

DETAILED DESCRIPTION OF THE INVENTION

Figure 1:
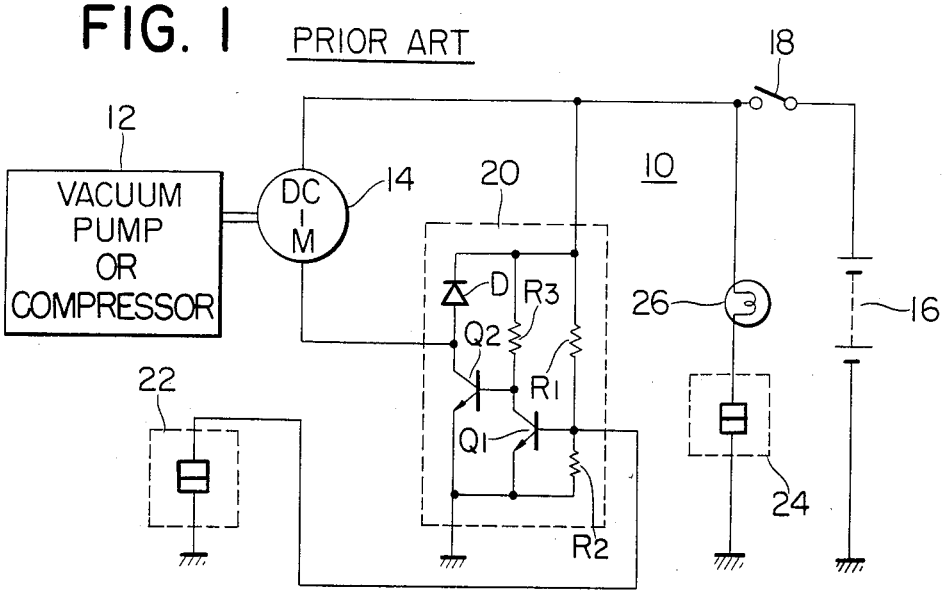
FIG. 1 PRIOR ART
FIG. 1 shows a circuit diagram of a pressure control apparatus in accordance with the prior art.
Figure 3:
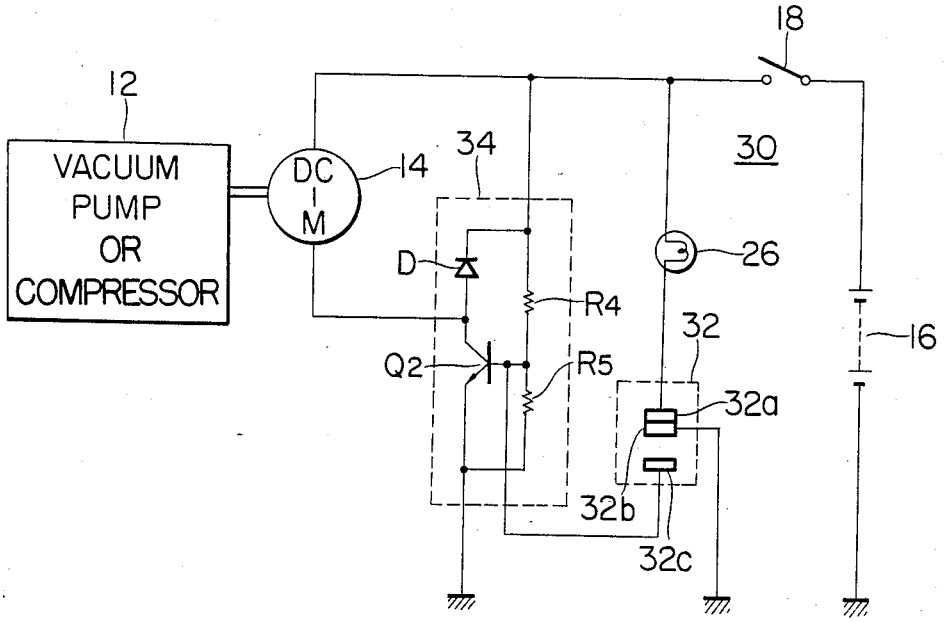

Referring to FIG. 3, there is shown a pressure control apparatus, generally designated by a reference numeral 30, according to a preferred embodiment of the present invention in which a sensor 32, embraced by dotted lines, is employed as a pressure sensing means instead of the separate sensors 22 and 24 in FIG. 1. The sensor 32 is of a transfer contact type in which a first stationary contact 32*a* is connected to the alarm lamp 26, a movable contact 32*b* is grounded, and a second stationary contact 32*c* is connected to the base of the power transistor Q2 in the control circuit 34 embraced by dotted lines. The control circuit 34 includes resistors R4 and R5 which are respectively connected between the base of the transistor Q2 and the key switch 18 as well as the emitter of the transistor Q2 as grounded. Otherwise, the pressure control apparatus 30 of the invention has the same arrangement as that shown in FIG. 1.

In operation, it will be described with reference to FIG. 2 which also illustrates the relationship between the operation of the sensor 32 and the degree of vacuum, and to FIG. 3 and the vacuum pump or compressor 12 will be assumed to be a vacuum pump for explanation purposes.

Before a vehicle in which the pressure control apparatus 30 is installed is started, or when the key switch 18 is left open for long, the pressure within the vacuum booster or the reserve tank (not shown) is substantially equal to atmospheric pressure. Therefore, the contacts 32*a* and 32*b* are closed. In this state, when the key switch 18 is closed, a closed circuit consisting of the power source 16, the key switch 18, the alarm lamp 26, the contacts 32*a* and 32*b*, and the source 16 is formed to light the alarm lamp 26. At the same time, since the base of the power transistor Q2 is not grounded, a base current flows through the key switch 18, the base resistor R4 from the power source 16 to make the transistor Q2 conductive, thereby energizing the DC motor 14 as well as the vacuum pump 12 which may be replaced by a compressor as set forth above. As a result, the vacuum booster is negatively pressurized, i.e. the absolute pressure is gradually decreased.

Figure 2:
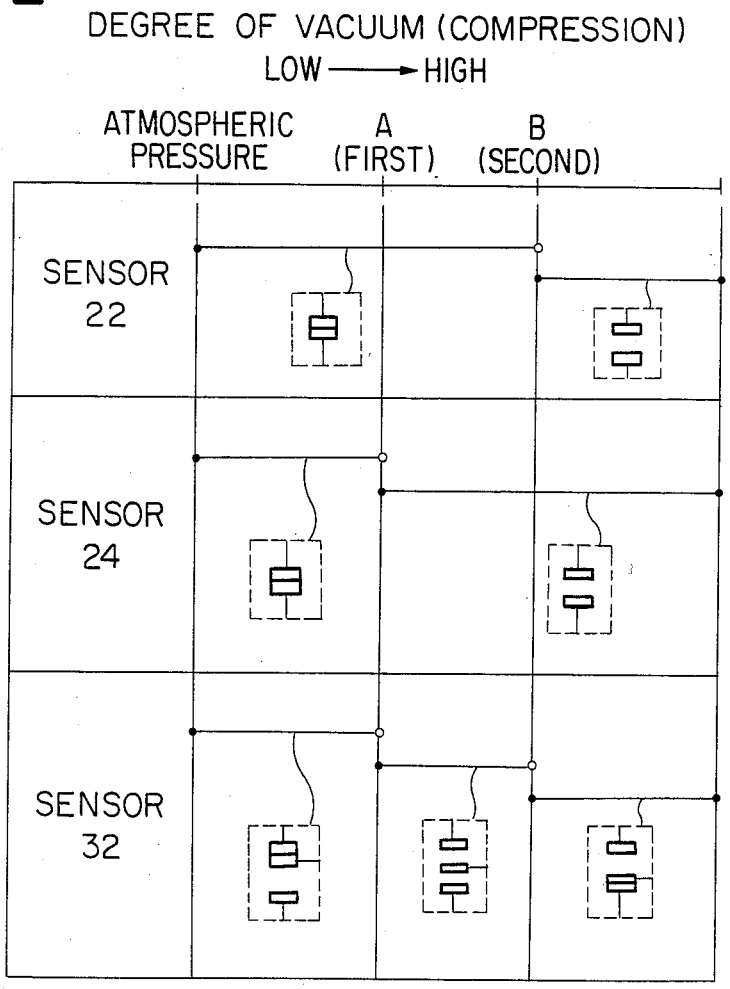
FIG. 2 shows a schematic diagram illustrating the relationship between the degree of vacuum (compression) and the operations of the sensors in the pressure control apparatus both in the prior art and the present invention; and, FIG. 3 shows a circuit diagram of a pressure control apparatus in accordance with a preferred embodiment of the present invention.

When the negative gauge pressure exceeds the first predetermined threshold value A, the movable contact 32*b* of the sensor 32 breaks contact with the contact 32*a* while it remains disconnected from the contact 32*c* as shown in FIG. 2. Therefore, the alarm lamp 26 is turned off while the DC motor 14 continues to be energized, still increasing the negative gauge pressure within the vacuum booster.

When the negative gauge pressure exceeds the second predetermined threshold value B which is higher in negative gauge pressure, i.e. lower in absolute pressure than the value A, the movable contact 32*b* now makes contact with the contact 32*c* while it remains disconnected from the contact 32*a* as shown in FIG. 2. Therefore, the power transistor Q2 has no base current flowing therethrough and so is made non-conductive, thereby deenergizing the DC motor 14 and in turn stopping the operation of the vacuum pump 12.

The continuation of this state naturally reduces the negative gauge pressure towards the second predetermined threshold value B, at which the movable contact 32*b* again breaks contact with the contact 32*c* to provide the base current for the transistor Q2 to be made conductive, thereby energizing the DC motor 14 and increasing the negative pressure. The repetition of these operations will cause the vacuum booster or reserve tank to be maintained at the second predetermined negative gauge pressure B.

If the DC motor 14 or the vacuum pump 12 should malfunction, then the negative gauge pressure continues to decrease towards the first predetermined negative gauge pressure A, at which the movable contact 32*b* then makes contact with the contact 32*a* as shown in FIG. 2 to light the alarm lamp 26, signalling a warning.

In the preferred embodiment described above, a vacuum pump has been employed as a pressure generating means for producing an absolute pressure below atmospheric pressure (i.e. a negative gauge pressure) in the vacuum booster. Alternatively, a compressor for producing an absolute pressure which is greater than atmospheric pressure (i.e. a positive gauge pressure) in the vacuum booster may be employed as a pressure generating means. In this manner, the pressure control apparatus with a large capacity may be formed, since the compressor can produce any desired pressure.

In accordance with the present invention as set forth above, it is advantageous that only a three-contact-type sensor as a pressure sensing means may be employed and therefore a pressure control apparatus with a simple arrangement and a low cost is obtained.

It will be apparent for any one skilled in the art that the present invention is not limited to the embodiment as described above but various modifications are possible without departing from the idea of the invention recited in the claims.

What is claimed is:

1. A pressure control apparatus comprising:

a pump means for generating a pressure different from atmosphere pressure when energized;

a pressure sensing means comprises a single pole, double throw electrical switch for providing both alarm and pressurizing signals when the absolute value of the gauge pressure generated by said pump means is below a first predetermined threshold value, and for providing a pressurizing signal when the absolute gauge pressure is below a second predetermined threshold value but is above said first threshold value, and for providing a stop signal when the absolute gauge pressure is above said second predetermined threshold value; and a control circuit connected to said pump means and said pressure sensing means for respectively energizing or deenergizing said pump means in response to said pressurizing or stop signal from said pressure sensing means.

2. A pressure control apparatus according to claim 1, wherein said pump means comprises a DC motor electrically connected to said control circuit and a vacuum pump mechanically connected to said DC motor.

3. A pressure control apparatus according to claim 2, wherein said switch of said pressure sensing means has a first stationary contact connected to an alarm lamp, a movable contact connected to ground, and a second stationary contact connected to said control circuit, said first stationary and movable contacts being closed to provide said alarm and pressurizing signals, all of said contacts being made open with respect to one another to provide said pressurizing signal, and said movable and second stationary contacts being closed to provide said stop signal.

4. A pressure control apparatus according to claim 3, further comprising a DC power source, having two terminals which are connected to said DC motor, and a diode connected to one of said two terminals of said DC power source, the other of said two terminals being connected to ground.

5. A pressure control apparatus according to claim 4, wherein said control circuit further includes a transistor having its base connected to said second stationary contact of said pressure sensing means, having its collector connected through a parallel combination of said diode and said DC motor to said one terminal of said DC power source, and having its emitter connected to ground.

6. A pressure control apparatus according to claim 1, wherein said pump means comprises a DC motor electrically connected to said control circuit and a compressor mechanically connected to said DC motor.

7. A pressure control apparatus according to claim 6, wherein said switch of said pressure sensing means has a first stationary contact connected to an alarm lamp, a movable contact connected to ground, and a second stationary contact connected to said control circuit, said first stationary and movable contacts being closed to provide said alarm and pressurizing signals, all of said contacts being made open with respect to one another to provide said pressurizing signal, and said movable and second stationary contacts being closed to provide said stop signal.

8. A pressure control apparatus according to claim 7, further comprising a DC power source, having two terminals which are connected to said DC motor, and a diode connected to one of said two terminals of said DC power source, the other of said two terminals being connected to ground.

9. A pressure control apparatus according to claim 8, wherein said control circuit further includes a transistor having its base connected to said second stationary contact of said pressure sensing means, having its collector connected through a parallel combination of said diode and said DC motor to said one terminal of said DC power source, and having its emitter connected to ground.

* * * * *